United States Patent [19]

Snider et al.

[11] 4,042,217

[45] Aug. 16, 1977

[54] LATHER GENERATOR

[76] Inventors: John H. Snider, 506 S. 3rd St., Clinton, Mo. 64735; Harold H. Snider, Rte. 2, Osceola, Mo. 64776

[21] Appl. No.: 715,524

[22] Filed: Aug. 18, 1976

[51] Int. Cl.[2] ..... B01F 15/00

[52] U.S. Cl. ..... 259/4 AB; 222/190; 252/359 E; 261/DIG. 26

[58] Field of Search ..... 222/190, 145; 259/4 R, 259/4 AC, 4 AB, 4 A, 8; 252/359 E, 307; 261/113, DIG. 26, DIG. 16; 239/311

[56] References Cited

U.S. PATENT DOCUMENTS

| | | | |
|---|---|---|---|
| 3,321,283 | 5/1967 | Ewald | 259/8 |
| 3,526,391 | 9/1970 | Church | 259/4 A |
| 3,712,512 | 1/1973 | Snider et al. | 222/190 |
| 3,856,270 | 12/1974 | Hemker | 259/4 AB |

*Primary Examiner*—Robert B. Reeves
*Assistant Examiner*—Hadd S. Lane
*Attorney, Agent, or Firm*—John A. Hamilton

[57] ABSTRACT

A lather generator operable to receive liquid soap and a suitable gas under pressure from separate sources into a mixing chamber in such a manner as to produce a thorough intermixture thereof, and then to pass the mixture through a series of successively larger expansion chambers interconnected by restricted passageways, lather being discharged from the final expansion chamber of the series.

8 Claims, 5 Drawing Figures

LATHER GENERATOR

This invention relates to the production of a soap lather suitable for shaving, washing of the hands and face, and the like from separate sources of liquid soap and gas under pressure, and has as its principal object the provision of a lather generator operable to receive the soap and gas and to discharge a rich, fine-grained lather.

Generally, this object is accomplished by intermixing the soap and gas thoroughly in an initial mixing chamber, while still under pressure, then passing the mixture through a series of successively larger expansion chambers interconnected by restricted passageways. This takes advantage of the fact that the size of the gas bubbles in the lather produced are somewhat directly proportional to the rate at which the gas is allowed to expand, a slower expansion rate producing a fine-grained lather in which the bubbles are relatively small, and a faster expansion rate producing a wetter, coarser lather in which the bubble size is relatively large.

Another object is the provision of a lather generator of the general character described which is adapted to function with either a gas already in vapor form, or with a gas which may be maintained in liquid form under pressure at normal ambient temperatures, and until its pressure is reduced by its expansion within the generator.

A further object is the provision of a lather generator of the general character described having features of construction which readily permit variation thereof to produce lather at variable rates, and with variable degrees of fineness, or bubble size.

Other objects are simplicity and economy of construction, and efficiency and dependability of operation.

Figure 2:
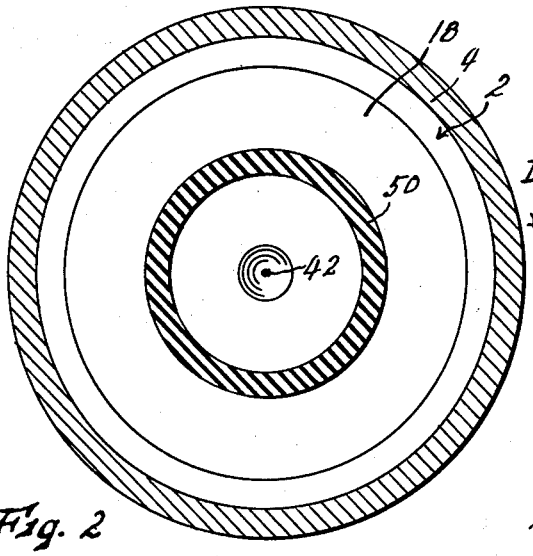
Figure 1:
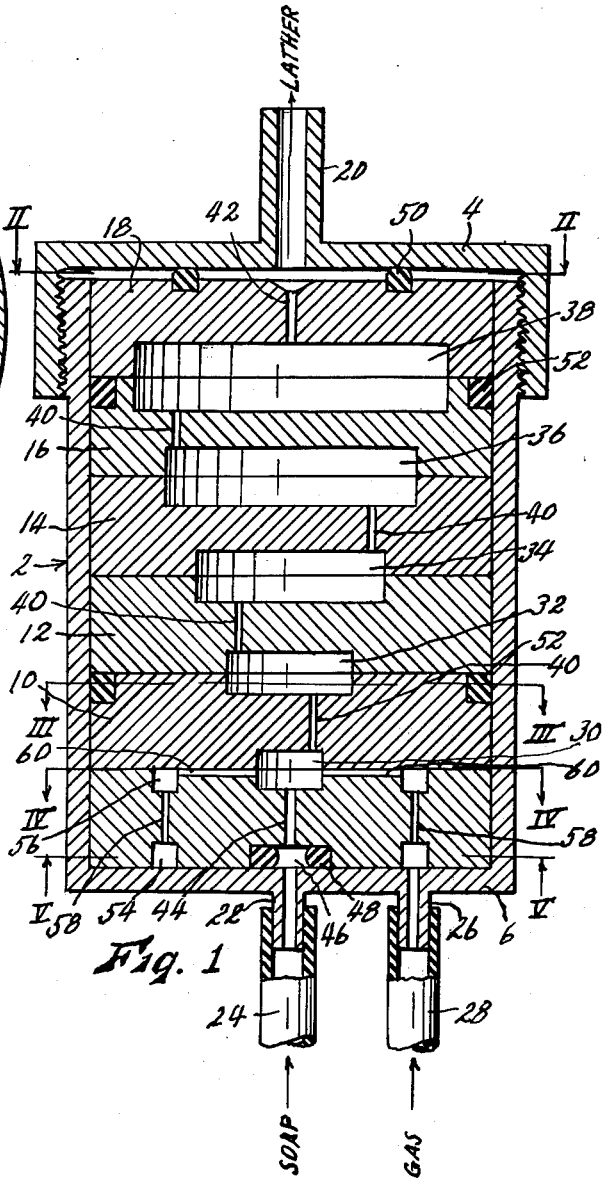
Figure 3:
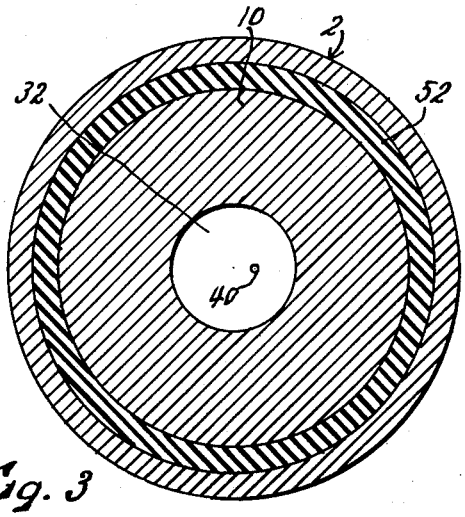
Figure 4:
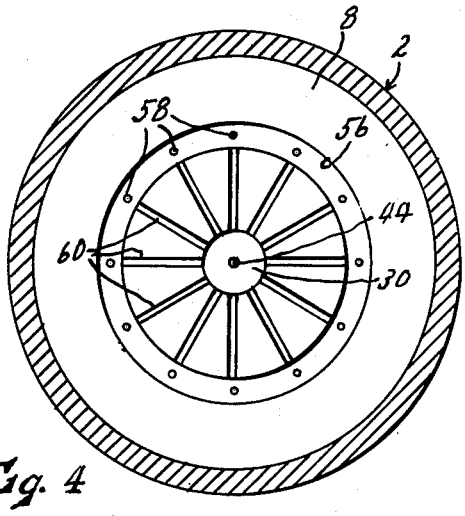
Figure 5:
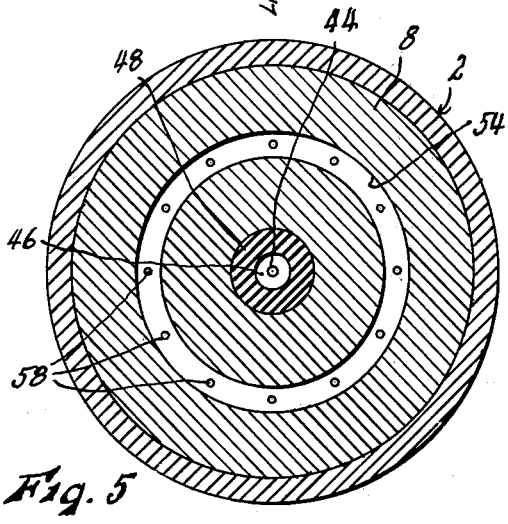

With these objects in view, as well as other objects which will appear in the course of the specification, reference will be had to the accompanying drawing, wherein:

FIG. 1 is a longitudinal, axial sectional view of a lather generator embodying the present invention, FIG. 2 is a sectional view taken on line II—II of FIG. 1, FIG. 3 is a sectional view taken on line III—III of FIG. 1, FIG. 4 is a sectional view taken on line IV—IV of FIG. 1, and FIG. 5 is a sectional view taken on line V—V of FIG. 1.

Like reference numerals apply to similar parts throughout the several views. The lather generator forming the subject matter of the present invention consists essentially of a housing 2 which is cylindrical, having a screw cap 4, and an integral end wall 6 at the end thereof opposite from said cap, and a series (six shown) of flat circular wafers 8, 10, 12, 14, 16 and 18 fitted snugly but slidably into housing 2, coaxially therewith, and occupying substantially the full axial length thereof. Cap 4 is provided with an axial, outwardly extending spout 20, through which finished lather issues as will appear. End wall 6 is provided with an axial, outwardly extending integral nipple 22 through which liquid soap under pressure, from any suitable source, not shown, is supplied to the interior of the housing, through a hose 24 connected to said nipple, and another nipple 26, spaced radially apart from nipple 22, through which a gas under pressure from any suitable source, not shown, is supplied to the interior of the housing through a hose 28 interconnected with said nipple.

The mating surfaces of the successive wafers 8, 10, 12, 14, 16 and 18 are cylindrically recessed, coaxially with the housing, whereby a chamber is formed between each confronting pair of wafers, the chambers being designated successively as 30, 32, 34, 36 and 38. Said chambers are, in the order given, of progressively larger volumes, which may be accomplished by increasing their diameters or increasing their thickness axially of the housing, or both. Each wafer wall separating adjacent chambers has a restricted orifice 40 formed therethrough to interconnect said chambers, said orifices preferably being staggered relative to the housing axis for a reason which will presently appear. Wafer 18 directly adjacent cap 4 has a restricted orifice 42 formed axially therethrough in alignment with spout 20. Wafer 8, directly adjacent end wall 6 of the housing, has a restricted orifice 44 formed axially therethrough to interconnect chamber 30 with a recess 46 formed in the surface of said wafer which directly abuts end wall 6, and which in turn communicates with soap nipple 22 of the housing. A circular rubber gasket 48 is inserted in recess 46 in encircling relation to orifice 44 and the opening of nipple 22, and is compressed between wafer 8 and end wall 6, whereby to prevent exit of liquid soap from recess 46 by any route except orifice 44, when the stack of wafers is axially compressed in the housing, as will appear. Another circular rubber gasket 50 is disposed between wafer 18 and cap 4, in encircling relation to orifice 42 of the opening of spout 20. Certain of the wafers, wafers 10 and 16 as shown, may also have peripheral grooves formed therein, said grooves opening both axially and radially of the wafer, in each of which is disposed a circular rubber gasket 52. As cap 4 is applied to the housing, it engages and compresses gasket 50, thereby applying an axial load to the stack of wafers. This forces the mating surfaces of the wafers, all formed accurately at right angles to the housing axis, into close engagement, forces end wafer 8 against end wall 6 to compress gasket 48, and expands gaskets 52 radially into close engagement with the interior wall surface of the housing.

Wafer 8 adjacent end wall 6 has an annular groove 54 formed in the surface thereof abutting end wall 6, gas nipple 26 of said end wall communicating with this groove, an annular groove 56 of the same diameter as groove 54 formed in the surface thereof abutting wafer 10, a series of orifices 58 formed therein and interconnecting grooves 54 and 56, and a series of radial grooves 60 formed in the surface thereof abutting wafer 10 and interconnecting groove 56 with the central recess thereof included in chamber 30.

In operation, it will be understood that the soap used is liquid, although it may be any of several types, such as shaving soap, hand soap, antiseptic surgical soap, or others, and that the gas may be of any suitable odorless, non-toxic type, such as air or many others. Also, it may be of the type commonly known as "liquid gas" such as dichlorodifluoromethane, known commercially as Freon, which is maintained in liquid form at ambient temperatures when pressurized to some reasonable degree, such as 15 p.s.i., but begins to vaporize whenever its pressure is reduced. In any container, only enough thereof will vaporize to establish the pressure thereover necessary to retain the remainder thereof in liquid form. This is referred to as its equilibrium pressure, and it varies with the ambient temperature.

The liquid soap and the gas, in either vapor or liquid form, is supplied to the generator housing, through hoses 24 and 28 respectively, at substantially equal pressures. How this equality is maintained is in itself not pertinent to the present application, but a simple means constitutes the supplying of the liquid soap from a container which is pressurized by the gas itself, which of course guarantees substantial equality of pressures.

The soap enters chamber 30, the smallest of the expansion chambers, through orifice 44 of wafer 8, in the form of a solid stream or spray of droplets, while the gas, either vapor, liquid, or a combination thereof, enters said chamber through groove 54, orifices 58, groove 56 and radial grooves 60 of wafer 8. The soap enters axially of said chamber, and the gas enters radially inwardly in the form of jets. The high velocity of the jets and their directional relation to the entry of the soap, creates an extreme turbulence in chamber 30, and an extremely thorough intermixture of the soap and the gas. Orifice 40 of wafer 10 interconnecting chamber 30 with the next larger chamber 32 is eccentrically offset from soap entry orifice 44 to reduce any possibility of direct "blow through" of liquid soap through chamber 30.

Fluid pressure in chamber 30 is of course reduced from the original supply pressure, due to the pressure drop across the restrictive entry orifices through which the soap and gas enter said chamber. Thus the gas expands to some degree, and in the case of gas originally in liquid form, such as Freon, some of it vaporizes to gaseous form, entering chamber 30 partially as gas and partially still in liquid form, the liquid portion also being intimately intermixed with the soap. The pressure in chamber 30, however, while reduced from supply pressure, remains elevated well above atmospheric pressure, due to the restrictions against escape to atmosphere provided by orifices 40 and 42 of the subsequent wafers 10, 12, 14, 16 and 18.

Thus, the soap-gas, or soap-liquid gas intermixture occurring in chamber 30 produces myriads of microscopically small gas-bubbles in the soap, or a soap-liquid gas mixture in which said bubbles will be formed when the gas is allowed to vaporize further by further reduction in the pressure thereof. However, if the mixture were allowed to pass directly from chamber 30 to the atmosphere, the expansion of the gas, or the vaporization and expansion of the liquid gas, would be so abrupt as to amount virtually to an "explosion", rupturing the liquid film forming the walls of some if not most of the small bubbles and allowing the gas to escape. The mixture thus ejected would be a very wet, sloppy mass having very few bubbles, and which would be completely unacceptable for use as lather. If the pressure of the mixture in chamber 30 could be reduced much more slowly before discharge to the atmosphere, this would allow time for the liquid soap in the bubble walls to "flow", as caused by the high surface tension of the soap, thus maintaining the bubble walls intact as against the rupture thereof caused by more rapid expansion of the gas therein resulting from rapid reduction of external pressure. When the lather is finally discharged to the atmosphere, this would produce a highly desired type of fine-grained lather in which the bubble size is small, and which is not wet and runny.

The reduction of the expansion rate of the gas trapped in the bubbles originally formed in chamber 30, or by liquid gas later vaporized by reduction of its pressure, is the primary object of this invention, and is accomplished by directing the soap-gas mixture formed in chamber 30 successively through chambers 32, 34, 36 and 38, which are interconnected in series by restricted orifices 40.

As the mixture enters chamber 32 through orifice 40 of wafer 10, its pressure is reduced, though the reduction is only a fraction of what it would have been if the mixture had been discharged to atmosphere, due both to the pressure drop across said orifice 40, and also to the relatively large volume of chamber 32 as compared to that of chamber 30. The gas trapped in the soap bubbles thus expands to a degree, the degree of expansion being sufficiently small, if the parts are properly designed, that the liquid soap film walls of the bubbles can flow to maintain said walls against rupture, or at least a high proportion thereof. The mixture has a certain retention time, or "dwell", in chamber 32 due to its large flow area as compared to that of orifice 40 of wafer 10, and this allows time for the flow of the film bubble walls to "adjust" to their now somewhat larger size.

The further reduction of the lather pressure, with consequent further expansion of the gas trapped in the bubbles and increase in the bubble size, occurs in like manner in further steps as the mixture passes through orifice 40 of wafer 12 into chamber 34, through orifice 40 of wafer 14 into chamber 36, through orifice 40 of wafer 16 to chamber 38, and actually also as the mixture passes through orifice 42 of wafer 18 and through spout 20 to the atmosphere. If all of the factors entering into the generation of the lather, such as the viscosity and surface tension of the liquid soap used, the nature of the gas used, the supply pressures and rates of the soap and gas, the number and size gradation of the successive expansion chambers, and the size of the restricting orifices, have been properly interrelated, the mixture in the final chamber 38 will have the form of a high-quality lather, rich, fine-grained, and with very small bubbles, and with only enough internal pressure to discharge it through spout 20 at an acceptable rate, as dictated by normal demand rates. It should be noted that while the above description of operation emphasizes the continual growth of bubble size, resulting from gradual reduction of pressure so as to cause only minimal rupture of the liquid film bubble walls, this does not mean that the bubble size in the finished lather will be large. The bubble size will still be sufficiently small to form a fine-grained lather. The larger bubble size of comparatively coarse-grained lathers does not result from the continued growth of single extremely small bubbles formed at the time of original intermixture of the soap and gas, but from the rupture of bubble walls by too-rapid reduction of pressure, such ruptures combining perhaps numerous smaller bubbles into a single larger bubble. Of course, the original bubble size must be extremely small, as provided by the extremely turbulent and thorough intermixture of the soap and gas in chamber 30, which as described constitutes both a mixing chamber and an expansion chamber.

The generator structure shown also has certain novel mechanical advantages. It is simple, economical to manufacture, and easy to assemble. Also, it permits the substitution therein of wafers other than those shown, which may vary as to number, and also as to chamber size and the sizes of orifices 40, and the flow capacities of the supply orifices for the soap and gas to mixing chamber 30. In this manner, the device may easily be accomodated to varying conditions, such as soaps of different characteristics, different supply pressures, and different characteristics desired in the finished lather.

Theoretically, since at least some of the bubbles will inevitably be ruptured at each step in the reduction of their pressure, and since the proportion of the bubbles ruptured would obviously be reduced if the pressure reduction steps were reduced in value, it would appear that the greater the number of chambers used, with correspondingly smaller steps of pressure reduction, the finer-grained the finished lather would be. It is also apparent that if the chambers were not successively enlarged as shown, but were for example all of equal volume, then pressure reductions in each successive chamber would still occur, and the bubbles would still gradually expand, due to the pressure drop occuring across each orifice 40. The value of each pressure reduction would be reduced, but of course a greater number of chambers would be required to reduce the pressure to a level suitable for expulsion of the lather to atmosphere. Experimentation has shown, however, that the use of four or five chambers, successively enlarged as shown, said progressive enlargement of course increasing the pressure drop occurring in each, so that the reduction from injection pressure to expulsion pressure, is ample to produce a high quality lather when the injection pressure is no higher than about 15 p.s.i., and the liquid soap is of a reasonably normal consistency and viscosity. Thinner, more watery soaps may require more gradual, and hence more numerous, pressure reduction steps, and they would also be required if the injection pressure were substantially higher, but under normal conditions as outlined, further multiplication of the number of chambers would produce only a minimal improvement in the finished lather, and can therefore be avoided in the interests of greater simplicity, economy and compactness of structure. Particularly where successively larger chambers are used, as shown, it is of some importance that the orifices 40 providing entry to and exit from each chamber be disposed adjacent diametrically opposite sides of the chamber. This assists in providing full flow in the chamber, tending to prevent clogging or stagnation of the forming lather in portions thereof, which would result in localized or "channelled" flow of the lather in the chamber. Said "channelled" flow would increase the flow rate in the chamber, decrease the retention time of the lather therein, and decrease the pressure reduction accomplished in that chamber, all of which would tend to decrease the quality of the finished lather.

Finally, while either gas pressurized in fully vaporized, gaseous form such as air, or "liquid gas" such as Freon, could be used, the latter is actually preferred. One advantage is that to some degree it produces a finer-grained lather, for the reason that at least some of it does not vaporize to gaseous form until later stages of the expansion process, that is, in progressively later of the expansion chambers, and that the bubbles formed by this later vaporization do not pass through as many expansion stages, and thus are not expanded to as large a size as are the bubbles formed in chamber 30 or earlier of the expansion chambers. Another advantage of the liquid gas occurs if the generator as shown is to be incorporated in a larger portable housing which also carries soap and gas storage means, and pressurizing means. The liquid gas is "self-pressurizing" in that a container therefor is automatically repressurized to equilibrium pressure whenever any of the gas is withdrawn therefrom, and also permits the storage of a much greater supply of gas in a container of a given size than is possible with gas which is merely compressed.

While we have shown and described a specific embodiment of our invention, it will be readily apparent that many minor changes of structure and operation could be made without departing from the spirit of the invention.

What we claim as new and desire to protect by Letters Patent is:

1. A lather generator comprising:

a. a housing having a pair of inlets respectively for liquid soap and gas, and an outlet for lather generated therein, and b. means carried in said housing and forming a series of open chambers, the first chamber of said series being of smaller volume than any other of said chambers, means operable to direct soap and gas delivered under pressure to said inlets into said first chamber of said series, and to intermix them thoroughly in said first chamber, under substantially elevated pressure whereby to inhibit growth of the size of the gas bubbles thereby formed in said liquid soap, restricted passageways interconnecting said chambers in series, and a passageway interconnecting the final chamber of said series to said housing outlet.

2. A lather generator as recited in claim 1 wherein the volume of each chamber in said series of chambers is greater than the volume of the chamber next preceding it in said series.

3. A lather generator as recited in claim 1 wherein said means carried in said housing includes means forming:

a. a first passage operable to conduct liquid soap from one of said inlets and to deliver said soap into the first chamber of said series, and b. second passageways operable to conduct gas from the other of said inlets and to deliver said gas into the first chamber of said series, delivery to said chamber being in the form of pressurized jets, whereby to improve the intermixture of said soap and said gas.

4. A lather generator as recited in claim 3 wherein said first passageway injects liquid soap into first chamber in the form of a generally undirectional jet, and wherein said second passageways inject gas into said first chamber in the form of jets directed into said first chamber in directions at an angle to the direction of said soap jet, and impinging said soap jet, whereby to improve the intermixture of said soap and said gas.

5. A lather generator as recited in claim 3 wherein said first passageway injects liquid soap into said first chamber in the form of a generally undirectional stream, and wherein said second passageways direct gas into said first chamber in a series of jets directed radially inwardly toward the axis of said soap stream, the axes of said gas jets being angularly spaced about the axis of said soap stream and intersecting said soap stream axis.

6. A lather generator as recited in claim 1 wherein said means carried in said housing includes a series of separate wafers carried removably in said housing in stacked relation, said chambers being formed by matching recesses formed in the abutting surfaces of each successive pair of wafers, and wherein said restricted passageways interconnecting said chambers in series constitute an orifice formed in each wafer, said orifice extending axially to the wafer stack and interconnecting the chamber recesses formed in the opposite surfaces of each wafer.

7. A lather generator as recited in claim 6 wherein said housing is provided with a removable cap permitting said wafers to be removed from said housing for the optional substitution therefor of other wafers having different characteristics, such as different chamber and orifice sizes.

8. A lather generator as recited in claim 7 wherein said cap is applicable to said housing in a direction axial to said stack of wafers, and with the addition of resilient sealing members interposed between said cap and the adjacent wafer, and between said wafers and said housing, whereby application of said cap to said housing compresses said sealing members to apply an axial load to said stack to prevent leakage therebetween, and to form a seal between said wafers and said housing, whereby passage of soap and gas through said housing except through the chambers, passageways and orifices of said wafers is prevented.

* * * * *